US007571994B2

(12) United States Patent
Kanaya

(10) Patent No.: US 7,571,994 B2
(45) Date of Patent: Aug. 11, 2009

(54) LIQUID-JET HEAD AND LIQUID-JET APPARATUS

(75) Inventor: Munehide Kanaya, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 512 days.

(21) Appl. No.: 11/519,880

(22) Filed: Sep. 13, 2006

(65) Prior Publication Data

US 2007/0058005 A1 Mar. 15, 2007

(30) Foreign Application Priority Data

Sep. 13, 2005 (JP) ..... 2005-265435

(51) Int. Cl.
*B41J 2/045* (2006.01)

(52) U.S. Cl. ..... 347/72

(58) Field of Classification Search ..... 347/72, 347/68, 69, 70, 71; 400/124.16
See application file for complete search history.

(56) References Cited

U.S. PATENT DOCUMENTS

2006/0098058 A1* 5/2006 Yazaki ..... 347/72

FOREIGN PATENT DOCUMENTS

JP 8-276586 A 10/1996
JP 11-58739 A 3/1999
JP 11-254681 A 9/1999
JP 2000-33713 A 2/2000
JP 2003-145778 A 5/2003
JP 2005-96419 A 4/2005

* cited by examiner

*Primary Examiner*—K. Feggins
(74) *Attorney, Agent, or Firm*—Sughrue Mion, PLLC

(57) ABSTRACT

A liquid-jet head includes: head main bodies each including at least a nozzle plate in which nozzle orifices are formed, each of the nozzle orifices being that from which liquid droplets are ejected; a passage-forming substrate, the nozzle plate being joined to one surface of the passage-forming substrate, and a plurality of pressure generating chambers respectively communicating with the nozzle orifices being arranged side by side in the passage-forming substrate; and pressure generators, each of which applies pressure to a liquid in each of the corresponding pressure generating chambers; and a fixing plate including exposure ports through which to expose the nozzle orifices to the outside respectively in areas corresponding to the head main bodies, the plurality of head main bodies being aligned and fixed, at predetermined intervals, to the fixing plate, the liquid-jet head wherein the fixing plate includes a reservoir forming plate, a compliance plate and a sealing plate, the reservoir forming plate being provided with a reservoir communicating with the plurality of pressure generating chambers, the compliance plate being joined to one surface of the reservoir forming plate, the compliance plate including a flexible portion in an area facing the reservoir, the flexible portion being capable of changing in shape depending on change of pressure in the reservoir, the sealing plate being joined to the other surface of the reservoir forming plate, and the sealing plate thus sealing the reservoir.

7 Claims, 5 Drawing Sheets

LIQUID-JET HEAD AND LIQUID-JET APPARATUS

The entire disclosure of Japanese Patent Application No. 2005-265435 filed Sep. 13, 2005 is expressly incorporated by reference herein.

BACKGROUND

1. Technical Field

The present invention relates to a liquid-jet head for ejecting liquids and a liquid-jet apparatus on which the liquid-jet head is mounted. Specifically, the invention relates to an inkjet recording head for ejecting ink droplets by displacement of pressure generating means each for applying pressure to liquids respectively in pressure generating chambers communicating with corresponding nozzle orifices from which to eject ink droplets, and to an inkjet recording apparatus on which the inkjet recording head is mounted.

2. Related Art

Inkjet recording heads are mounted on inkjet recording apparatuses, including printers and plotters. Each inkjet recording head has a plurality of head main bodies each capable of ejecting an ink in the form of ink droplets. Such inks are contained respectively in ink reservoir portions in an ink cartridge, an ink tank or the like.

A general model of such an inkjet recording apparatus is capable of making color prints by ejecting ink droplets in a plurality of colors. An inkjet recording head is mounted on such an inkjet recording apparatus. The inkjet recording head has a plurality of head main bodies each for ejecting ink droplets. The plurality of head main bodies are assigned respectively to mutually different colors. Examples of this type of inkjet recording head (an inkjet recording head unit) include an inkjet recording head in which the head main bodies (inkjet recording heads) are aligned and fixed, at predetermined intervals, to a fixing plate provided near a nozzle plate. (Refer to Scope of claims, FIGS. 1 and 5, and the like in JP-A-2005-096419: hereinafter referred to as "Patent Document 1.")

As described in Patent Document 1, for example, each head main body is configured of a passage-forming substrate, a nozzle plate, a reservoir forming plate and the like. The passage-forming substrate is formed of a single crystal silicon substrate, and is provided with pressure generating chambers and communicating portions constituting parts of each of the reservoirs. Nozzle orifices are formed in the nozzle plate, and communicate respectively with the pressure generating chambers. The reservoir forming plate includes reservoir portions and piezoelectric element holding portions. Each of the reservoir portions along with their corresponding communicating portions constitutes the reservoir. The piezoelectric element holding portion protects the piezoelectric elements.

In the case of a head main body with such a configuration, both the pressure generating chambers and parts of the reservoir are formed in the passage-forming substrate. This formation makes the area of the passage-forming substrate larger. As a result, this enlargement brings about a problem that an inkjet recording head with a plurality of head main bodies arranged side by side therein is also constructed larger. Furthermore, an interstice between each two of the head main bodies is wider. In other words, an interstice between each two rows of nozzle orifices is wider, and this accordingly makes it impossible to arrange nozzle orifices in high density. This also brings about a problem that it is difficult to enhance recording quality.

Problems of these types are common not only among inkjet recording heads for ejecting ink, but also among liquid-jet heads each for ejecting liquids other than ink.

SUMMARY

An advantage of some aspects of the invention is to provide a liquid-jet head which makes it possible to arrange head main bodies closer to one another, and which enables printing quality to be enhanced. The advantage of some aspects of the invention is to provide to a liquid-jet apparatus on which the liquid-jet apparatus is mounted.

A first aspect to the invention is a liquid-jet head characterized by including head main bodies and a fixing plate. Each of the head main bodies includes a nozzle plate, a passage-forming substrate and a plurality of pressure generating means at a minimum. Nozzle orifices each from which to eject liquid droplets are formed in the nozzle plate. The nozzle plate is joined to a surface of the passage-forming substrate. A plurality of pressure generating chambers communicating respectively with the nozzle orifices are arranged side by side in the passage-forming substrate. Each of the plurality of pressure generating means applies pressure to a liquid in each of the corresponding pressure generating chambers. The fixing plate includes exposure ports each through which to expose nozzle orifices to the outside respectively in areas in the fixing plate, which correspond to the plurality of head main bodies. The plurality of head main bodies are aligned and fixed, at predetermined intervals, to the fixing plate. The liquid-jet head is also characterized in that the fixing plate includes a reservoir forming plate, a compliance plate and a sealing plate. The reservoir forming plate is provided with reservoirs each communicating with pressure generating chambers. The compliance plate is joined to a surface of the reservoir forming plate, and has flexible portions respectively in areas in the compliance plate, which face the reservoirs. Each of the flexible portions is capable of changing in shape depending on the change of pressure in one of the corresponding reservoirs. The sealing plate is joined to the other surface of the reservoir forming plate, and accordingly seals the reservoirs.

In the case of the first aspect, the reservoirs are provided to the fixing plate, and accordingly it suffices that only the pressure generating chambers are formed in the passage-forming substrate. This makes the area of the passage-forming substrate smaller. As a result, the head main bodies are constructed in a smaller size. The construction of the head main bodies in a smaller size makes it possible to produce the liquid-jet head in a smaller size. Furthermore, the construction makes it possible to narrow the interstice between each two of the head main bodies (the interstice between each two rows of nozzle orifices). In other words, the nozzle orifices can be arranged in high density. This arrangement enhances printing quality.

A second aspect of the invention is the liquid-jet head as recited in the first aspect, which is characterized in that a group of pressure generating chambers and their corresponding reservoirs communicate with each other through a corresponding one of penetrated holes provided in the compliance plate, and through a corresponding one of supply ports each configured of a plurality of fine holes provided in the nozzle plate.

In the case of the second aspect, air bubbles are prevented from being mixed into a liquid, and this makes it possible to supply the liquid from each of the reservoirs to the corresponding pressure generating chambers.

A third aspect of the invention is the liquid-jet head as recited in any one of the first and the second aspects, which is characterized in that the nozzle plate is formed of a single crystal silicon substrate.

In the case of the third aspect, the nozzle orifices and the supply port can be formed with high precision, and this enhances their properties of ejecting liquid droplets.

A fourth aspect of the invention is the liquid-jet head as recited in any one of the first to the third aspects, which is characterized in that the compliance plate includes an elastic sheet formed of an elastic material, and a reinforcement plate which is joined onto the elastic sheet, and which thus fixes the elastic sheet thereto, and the flexible portion is formed of the elastic sheet only.

In the case of the fourth aspect, displacement of the elastic sheet serving as the flexible portions always maintains pressure in the reservoir at a constant level.

A fifth aspect of the invention is the liquid-jet head as recited in any one of the first to the fourth aspects, which is characterized in that a passage member is further joined to the top of the fixing plate. The passage member is provided with communicating paths respectively in areas in the passage member, and the areas correspond to the reservoirs. The communicating paths constitute parts respectively of passages. Each of the passages connects a corresponding one of the reservoirs to corresponding liquid holding means in which a liquid to be supplied to the reservoir is held. In addition, the passage member includes head holding portions respectively in areas in the passage member, and the areas correspond respectively to the head main bodies.

In the case of the fifth aspect, liquids are supplied in a preferable manner to the respective reservoirs through the corresponding communicating paths in the passage member. In addition, the head main bodies are constructed in a smaller size. These facilitate construction of the passage member including the communicating paths in a smaller size.

A sixth aspect of the invention is the liquid-jet head as recited in any one of the first to the fifth aspects, which is characterized in that the pressure generators are piezoelectric elements provided to the passage-forming substrate's surface which is opposite to its other surface facing the nozzle plate with a vibration plate interposed between the passage-forming substrate and each of the piezoelectric elements.

In the case of the sixth aspect, liquid droplets are ejected from the nozzle orifices depending on the drive of the respective piezoelectric elements. In addition, only the pressure generating chambers are formed in the passage-forming substrate. As a result, no cracks or the like occurs in the vibration plate even though the liquid-jet head is configured to include such piezoelectric elements.

A seventh aspect of the invention is a liquid-jet apparatus including the liquid-jet head as recited in any one of the first to the sixth aspects.

In the case of the seventh aspect, reliability can be enhanced, and a smaller-sized liquid-jet apparatus can be realized.

BRIEF DESCRIPTION OF THE DRAWINGS

The invention will be described with reference to the accompanying drawings, wherein like numbers reference like elements.

DESCRIPTION OF EXEMPLARY EMBODIMENTS

Detailed descriptions will be provided below for the invention on a basis of the embodiments.

Embodiment 1

Figure 1:
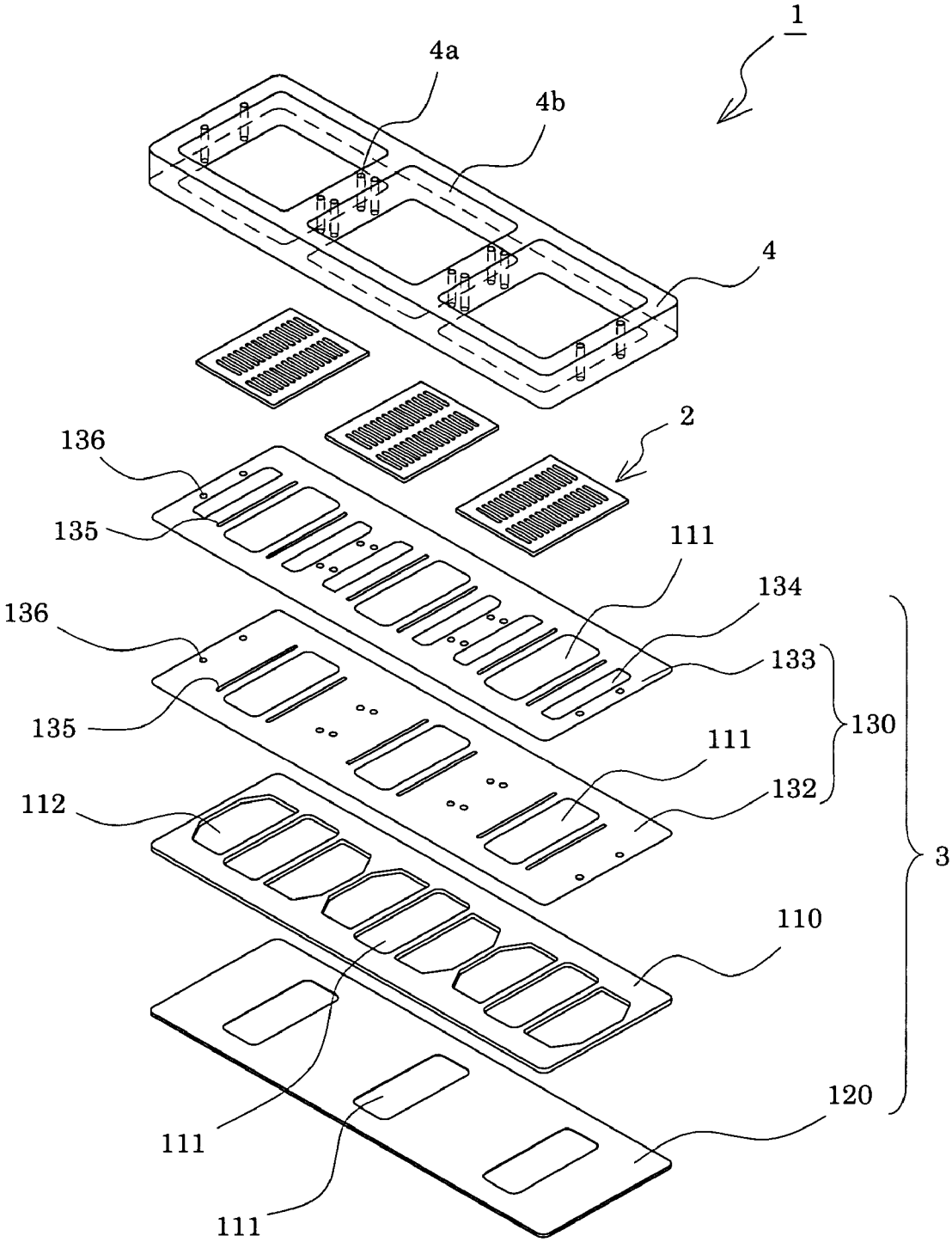
FIG. 1 is an exploded, perspective view of a recording head according to embodiment 1.
Figure 2:
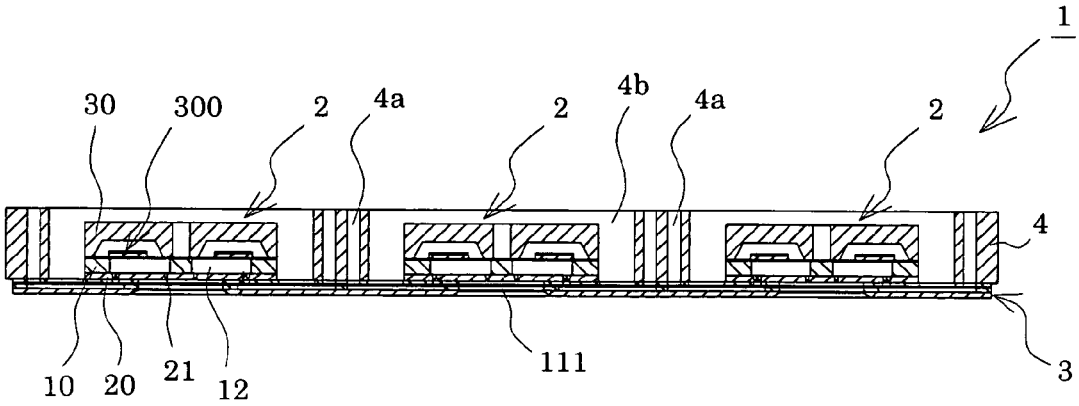
FIG. 2 is a cross-sectional view of the recording head according to embodiment 1.

FIG. 1 is an exploded, perspective view showing an inkjet recording head according to embodiment 1 of the invention. FIG. 2 is a cross-sectional view showing a chief part of the inkjet recording head.

As shown in FIG. 1, the inkjet recording head 1 according to the present embodiment includes a plurality of head main bodies 2, a fixing plate 3 and a passage plate 4. The plurality of head main bodies 2 are aligned and fixed to the fixing plate 3. The passage plate 4 along with the head main bodies 2 is joined to a fixing plate 3.

As shown in FIG. 2, each of the head main bodies 2 according to the present embodiment is configured of a passage-forming substrate 10, a nozzle plate 20 and a protective plate 30. Pressure generating chambers 12 are formed in the passage-generating substrate 10. Drive of each of piezoelectric elements 300 applies pressure to corresponding each of the pressure generating chambers 12. The piezoelectric elements 300 are an example of pressure generating means. The nozzle plate 20 is joined to one surface of the passage-forming substrate 10. The protective plate 30 is joined to the other surface of the passage-forming substrate 10, and this surface is at the side where the piezoelectric elements 300 are formed on the passage-forming substrate 10.

Each of the head main bodies 2 is designed to be capable of ejecting ink by supplying the head main body 2 with the ink and drive signals. How each of the head main bodies 2 ejects the ink can be checked on without otherwise manipulating the head main body 2. Accordingly, the head main bodies 2 are characteristic in that, when the plurality of head main bodies are arranged, ink is scattered narrowly, and that the arrangement of the head main bodies 2 realizes an inkjet recording head with high yields.

The passage-forming substrate 10 is formed of a single crystal silicon substrate. An elastic film 50 is formed on a surface of the passage-forming substrate 10. The elastic film 50 is formed beforehand of silicon dioxide by thermal oxidation. The pressure generating chambers 12 are formed in two rows in the passage-forming substrate 10 by anisotropically etching the passage-forming substrate 10 from the opposite surface thereof. In each of the two rows, pressure generating chambers 12 are arranged one by one in their width direction. Each of the pressure generating chambers is defined by compartment walls. The nozzle plate 20 is fixed to a surface of the passage-forming substrate 10 with an adhesive agent, a thermal adhesion film or the like, the surface being that which has openings for the pressure generating chambers 12.

Nozzle orifices 21 each from which to eject ink droplets are formed in the nozzle plate 20. Each of the nozzle orifices 21 communicates with an end portion in the longitudinal direction of each of the corresponding pressure generating chambers 12, the end portion being located near the center of the corresponding passage-forming substrate 10. In addition, the nozzle plate 20 is provided with ink supply ports 22. Each of the ink supply ports 22 communicates with an end portion on the opposite side of each of the corresponding pressure generating chambers 12. The opposite side is a side opposite to the side where the corresponding nozzle orifices 21 are formed. Each of the pressure generating chambers 12 is supplied with an ink from a corresponding one of reservoirs, which will be described later, through a corresponding ink supply port 22. Each of the ink supply ports 22 according to the embodiment is constituted of a plurality of fine holes. No specific restriction is imposed on the size (diameter) of the fine holes. It is preferable, however, that the fine holes be small in size (diameter). It is desirable that the fine holes be smaller in size (diameter) than the nozzle orifices 21.

It should be noted that it is preferable that a material having a linear expansion coefficient closer to that of the passage-forming substrate 10 be used as a material for the nozzle plate 20. In the case of the present embodiment, a single crystal silicon substrate is used as the material for the nozzle plate 20. The nozzle orifices 21 and the ink supply ports 22 are formed by etching the single crystal silicon substrate. It is a matter of course that no specific restriction is imposed on the material for the nozzle plate 20. For example, stainless steal (SUS) may be used as the material for the nozzle plate 20. In the case where stainless steel is used, the nozzle orifices 21 and the ink supply ports 22 may be formed by pressing.

On the other hand, at a side of the passage-forming substrate 10, which side is opposite to its surface where the openings for the pressure generating chambers 12 are formed, an insulation film 55 is provided to the top of the elastic film 50. The insulation film 55 is made, for example, of zirconia ($ZrO_2$) or the like. A lower electrode film 60, piezoelectric layers 70 and upper electrode films 80 are superposed on one another on the top of the elastic film 55, and thus constitute piezoelectric elements 300. The lower electrode film 60 is made, for example, of a metal material such as platinum or iridium. The piezoelectric layers 70 are made, for example, of a piezoelectric material such as lead zirconate titanate (PZT). The upper electrode films 80 are made, for example, of a metal material such as iridium. The piezoelectric elements 300 are formed respectively in areas facing the pressure generating chambers 12. In this respect, each of the piezoelectric elements 300 and each of the corresponding vibration plates are collectively termed as an actuator. The vibration plates are displaced by drive of the respective piezoelectric elements 300.

In addition, the upper electrode films 80 are independent electrodes respectively of the piezoelectric elements 300. Lead electrodes 90 are connected respectively with the upper electrode films 80. In the case of the embodiment, one end of each of the lead electrodes 90 extends to the center of the passage-forming substrate 10 in the longitudinal direction of each of the corresponding piezoelectric elements 300. The tip portion of the extended end of each of the lead electrodes 90 is exposed to a penetrated portion 32 in the protective plate 30, which will be described later.

The protective plate 30 is joined to a surface of the passage-forming substrate 10 with an adhesive agent or the like, the surface being at the side where the piezoelectric elements 300 are formed on the passage-forming substrate 10. The protective plate 30 includes piezoelectric element holding portions 31 each for protecting the piezoelectric elements 300. In the case of the embodiment, the piezoelectric element holding portions 31 are independently provided to the areas in the protective plate 30, the areas respectively facing the rows of the piezoelectric elements 300. Because the piezoelectric elements 300 are formed in each of the piezoelectric element holding portions 31, the piezoelectric elements 300 are protected while being susceptible to almost none of the external environment. Incidentally, the piezoelectric element holding portions 31 may be sealed off from the external environment. It goes without saying that the piezoelectric element holding portions 31 do not have to be sealed off.

If an area where the passage-forming substrate 10 and the protective plate 30 are joined to each other includes a region constituted of nothing but the vibration plate, or if the joining area includes a region where an ink passage is formed, the inclusion brings about a problem that the vibration plate cracks in the region when the protective plate 30 is joined to the passage-forming substrate 10, or in an equivalent occasion. In the configuration of the invention, however, only the pressure-generating chambers 12 are formed in the passage-forming substrate 10, and no ink passage is formed in the region where the passage-forming substrate 10 and the protective plate 30 are joined to each other. This precludes the problem of a crack of the vibration plate from occurring.

The penetrated portion 32 is provided in the center portion of the protective plate 30, or in an area corresponding to an interstice between the two neighboring rows of the piezoelectric elements 300. The penetrated portion 32 penetrates through the protective plate 30 in the thickness direction. In addition, the lead electrodes 90 corresponding to the respective piezoelectric elements 300 are extended to an area facing the penetrated portion 32, as described above. Although not illustrated, the lead electrodes 90 are electrically connected to a driver IC or the like through connecting wirings extended in the penetrated portion 32, respectively. The driver IC is that which drives the piezoelectric elements 300. Incidentally, examples of the material for the protective plate 30 include glass, ceramic, metal and plastic. It is preferable, however, that a material having a linear expansion coefficient almost equal to that of the passage-forming substrate 10 be used as the material for the protective plate 30. For this reason, in the case of the embodiment, a single crystal silicon substrate is used as the material for the protective plate 30. The single crystal silicon substrate is the same material as is used for the passage-forming substrate 10.

The plurality of head main bodies 2 with the foregoing configuration are aligned and joined to the fixing plate 3 at predetermined intervals. In the case of the embodiment, three head main bodies 2 are aligned and joined thereto. Furthermore, in the case of the embodiment, the passage plate 4 along with the plurality of head main bodies 2 is joined to the fixing plate 3 (refer to FIG. 1).

Figure 3:
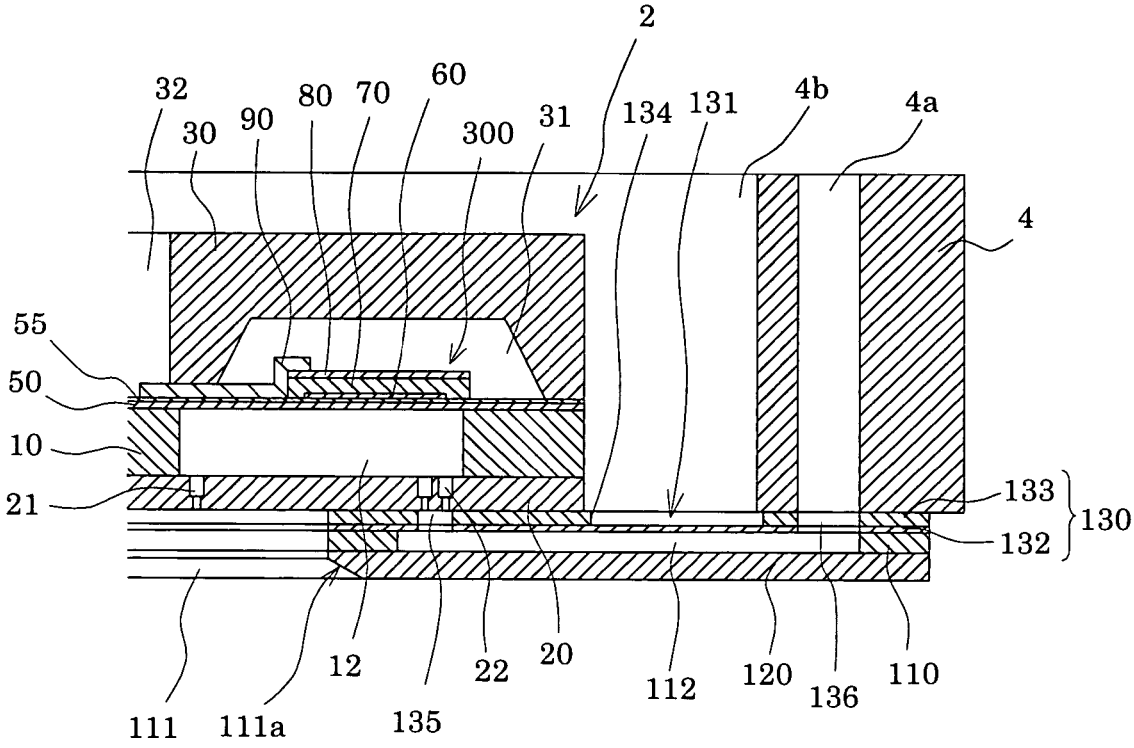
FIG. 3 is a magnified, cross-sectional view of the recording head according to embodiment 1.

In this respect, the fixing plate 3 according to an aspect of the invention is configured of a reservoir forming plate 110, a sealing plate 120 and a compliance plate 130. Exposure ports 111 each through which to expose a row of nozzle orifices 21 to the outside are provided to areas in the fixing plate 3. These areas correspond to the rows of nozzle orifices 21 of each of the head main bodies 2. The exposure ports 111 penetrate the reservoir forming plate 110, the sealing plate 120 and the compliance plate 130. Incidentally, it is preferable that an edge of an opening of each of the exposure ports 111 should take on the form of a tapered surface 111*a* obtained by beveling (refer to FIG. 3). The edge taking on the tapered surface 111*a* is intended to help to smoothly wipe the surface of each of the nozzle orifices 21.

The reservoir forming plate 110 is formed, for example, of a material such as a single crystal silicon substrate. The reservoir forming plate 110 has reservoirs 112 which correspond respectively to the rows of the pressure generating chambers 12. Each of the reservoirs 112 penetrates through the reservoir forming plate 110 in the thickness direction thereof. The sealing plate 120 made, for example, of a material such as a single crystal silicon substrate is joined to one surface of the reservoir forming plate 110, that is, a surface being opposite to the surface facing the head main bodies 2. Thereby, one side of each of the reservoirs 112 is sealed off with the sealing plate 120.

The compliance plate 130 is joined to the other surface of the reservoir forming plate 110. Flexible portions 131 each capable of changing in shape depending on the change of pressure in the respective reservoirs 112 are provided to areas in the compliance plate 130, which correspond to the reservoirs 112. Pressure change in each of the reservoirs 112 is virtually absorbed by displacement of each of the corresponding flexible portions 131. Accordingly, pressure in each of the reservoirs 112 is always maintained at a substantially constant level.

In the case of this embodiment, the compliance plate 130 includes an elastic sheet 132 and a reinforcement plate 133. The elastic sheet 132 is made of an elastic material such as a resin material. The reinforcement plate 133 is made, for example, of stainless steel (SUS) or the like, and reinforces the elastic sheet 132. The compliance plate 130 is joined to the reservoir forming plate 110 with the elastic sheet 132 therein facing the reservoir forming plate 110. Penetrated portions 134 are formed respectively in areas in the reinforcement plate 133. The areas correspond respectively to the reservoirs. The penetrated portions 134 penetrate through the reinforcement plate 133 in the thickness direction thereof. Insides of these penetrated portions 134 serve as the flexible portions 131 made up of only the elastic sheet 132.

Moreover, ink supply communicating ports 135 are formed in the compliance plate 130. An end of each of the ink supply communicating ports 135 communicates with a corresponding one of the reservoirs 112. The other end of the ink supply communicating ports 135 communicates with the ink supply ports 22 in each of the nozzle plates 20. Each of the reservoirs 112 provided in the reservoir forming plate 110 communicates with the corresponding pressure generating chambers 12 of one of the corresponding head main bodies 2 through the corresponding ink supply communicating ports 135 and the corresponding ink supply ports 22 provided in the nozzle plate 20.

Note that the ink supply communicating ports 135 may be provided respectively to the pressure generating chambers 12 with the ink supply communicating ports independent of one another. In the case of this embodiment, however, each of the ink supply communicating ports 135 is formed in the shape of a slit. Although formed in the shape of the slit, the ink supply communicating ports 135 enables ink to be supplied to the corresponding pressure generating chambers 112 in a preferable condition. This is because the ink supply ports 22 provided in each of the nozzle plates 20 are provides respectively to the corresponding pressure generating chambers 12 with the ink supply ports 22 independent of one another. In addition, ink introducing ports 136 are further provided to the compliance plate 130. The ink introducing ports 136 are those through which ink is supplied to the corresponding reservoirs 112. No specific restriction is imposed on the number of the ink introducing ports 136. In the case of this embodiment, however, two ink introducing ports 136 are provided to each of the reservoirs 112.

A passage plate 4 including ink communicating paths 4*a* is joined to the top of the compliance plate 130. An end of each of the ink communicating paths 4*a* communicates with its corresponding ink introducing port 136. The other end of each of the ink communicating path 4*a* communicates with corresponding ink holding means (not illustrated) such as an ink cartridge. The passage plate 4 according to this embodiment includes head holding portions 4*b* respectively in areas in the passage plate 4, which correspond to the head main bodies 2. Each of the head holding portions 4*b* penetrates through the passage plate 4 in the thickness direction thereof. Thus, the passage plate 4 is provided in a way that the head holding portions 4*a* surround the respective head main bodies 2. In addition, the passage plate 4 is provided with the ink communicating paths 4*a* respectively in its positions corresponding to the ink introducing ports 136 in the compliance plate 130. Thus, ink in the ink holding means is designed to be supplied to the corresponding reservoirs 112 through the corresponding ink communicating paths 4*a* and the corresponding ink introducing ports 136.

In the case of the invention, only the pressure generating chambers 12 are formed in the passage-forming substrate 10 of each of the head main bodies 2, and the reservoirs 112 are provided to the fixing plate 3 to which the plurality of head main bodies 2 are fixed, as described above. This makes it possible to reduce the area of each of the passage-forming substrates 10, and to construct the actuators formed on the top of each of the passage-forming substrates 10 in a smaller size. These miniaturizations make it possible to cut back on costs to a large extent. In other words, the reduction of the area of each of the actuators whose construction entails higher manufacturing costs leads to a larger cutback of costs of manufacturing the heads.

Moreover, the reduction of the area of each of the passage-forming substrates 10 enables each of the corresponding head main bodies 2 to be constructed in a smaller size. This makes it possible to narrow the pitch with which the head main bodies 2 are arranged. The narrower pitch enables the interstice between each two neighboring rows of the nozzle orifices 21 to be narrowed as well. In other words, this embodiment makes it possible to arrange the nozzle orifices 21 in higher density, and to accordingly enhance printing quality.

Other Embodiments

Figure 4:
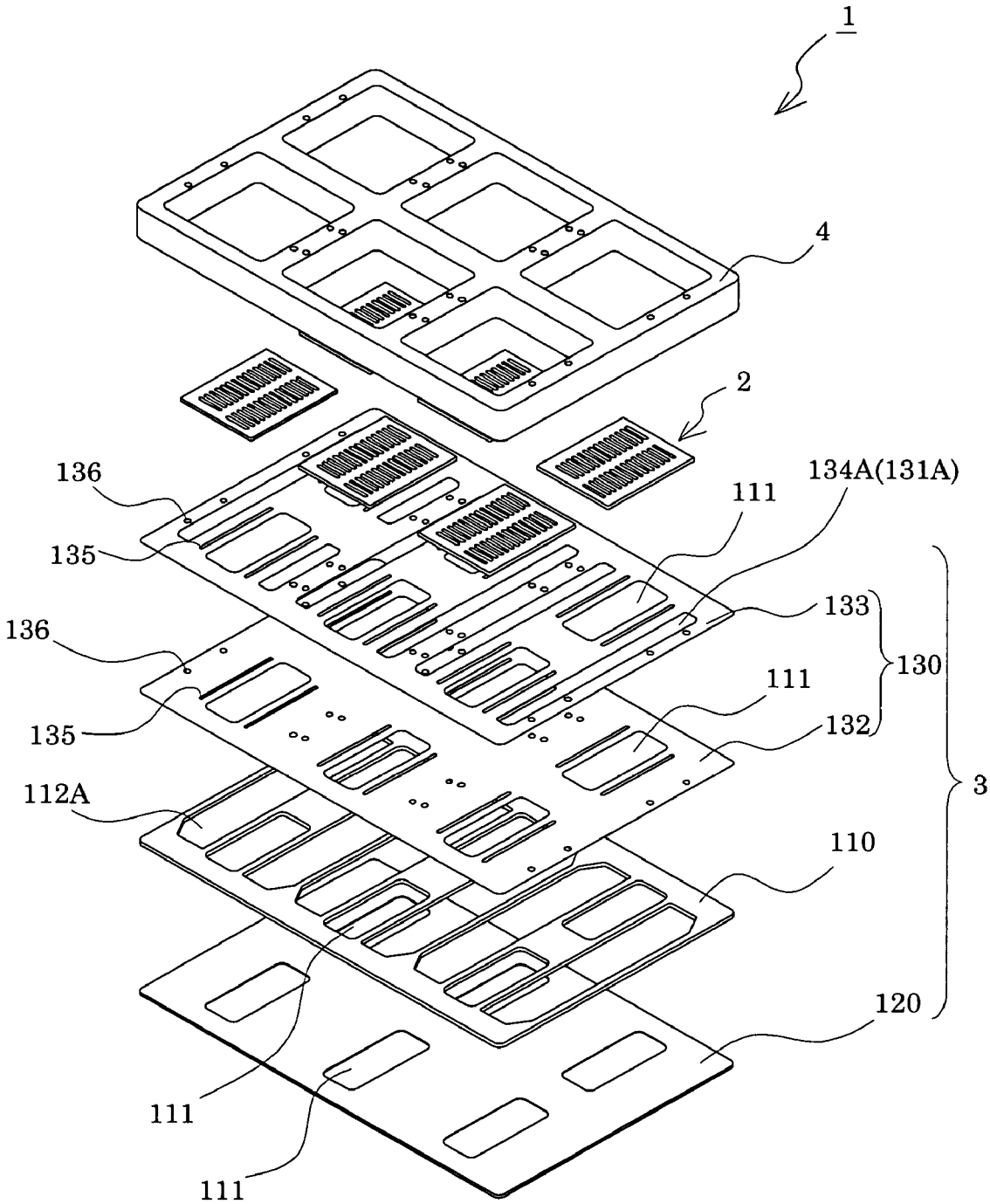
FIG. 4 is an exploded, perspective view showing a modified example of the recording head according to embodiment 1.

The foregoing descriptions have been provided for embodiment 1 of the invention. However, the invention is not limited to the above-described embodiment. In the case of the foregoing embodiment, for example, the head main bodies are arranged side by side in a direction orthogonal to the rows of the pressure generating chambers 12. However, the arrangement of the head main bodies 2 is not limited to this example. As shown in FIG. 4, for example, the head main bodies 2 may be arranged in plurality side by side not only in the direction orthogonal to the rows of the pressure generating chambers 12, but also in the same direction as the rows of the pressure generating chambers 12 extend. In this case, reservoirs 112A commonly shared by a plurality of head main bodies 2 may be formed in the fixing plate 3. Furthermore, in addition to forming the extended reservoirs 112A, penetrated portions 134A of the reinforcement plate 133, that is, flexible portions 131A may be formed in a way that each of the flexible portions 131A spans an area corresponding to a plurality of head main bodies 2. It goes without saying that, even in the case where this type of configuration is adopted, the pitch with which the head main bodies 2 are arranged can be narrowed. This can bring about an effect of enabling the inkjet recording head to be constructed in a smaller size, and an effect of enabling printing quality to be enhanced.

Furthermore, as for the foregoing embodiment, piezoelectric elements of the type which causes vibration by flex have been shown as the pressure generating means for applying pressure to the liquids respectively in the pressure generating chambers 12. However, no specific restriction is imposed on the type of pressure generating means. For example, piezoelectric elements of vertical vibration type, heat generating elements, and the like may be used as the pressure generating means. The piezoelectric elements of vertical vibration type are constructed by superposing an alternate series of piezoelectric materials and electrode forming materials on one another, and accordingly expand and contract in their axial direction.

Figure 5:
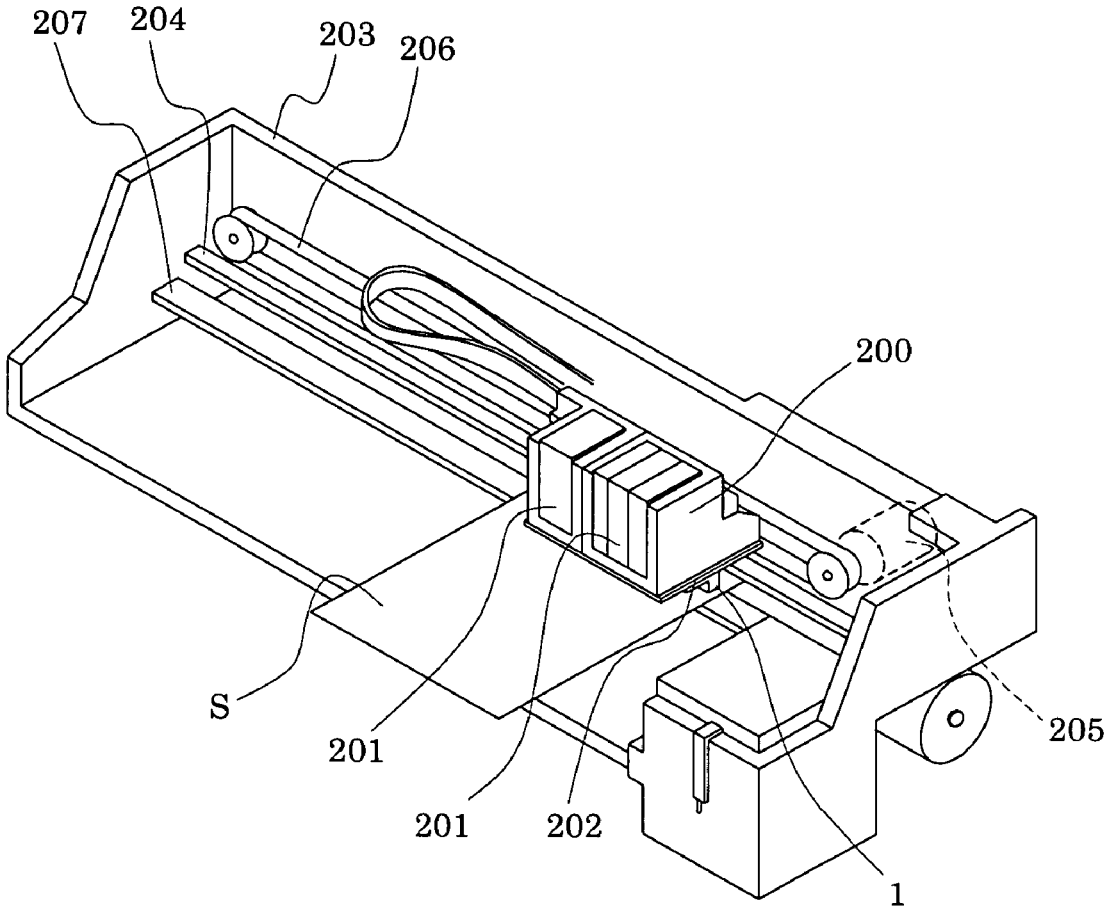
FIG. 5 is a schematic diagram of an inkjet recording apparatus according to an embodiment.

Note that, along with a holding member onto which liquid holding means such as ink cartridges are mounted, the inkjet recording head 1 according to the foregoing embodiment constitutes a head unit. Thereby, the inkjet recording head is mounted onto the inkjet recording apparatus. FIG. 5 is a schematic diagram showing an example of the inkjet recording apparatus. As shown in FIG. 5, a head unit 200 including an inkjet recording head 1 is mounted onto a carriage 202 while in a condition that ink cartridges 201 assigned respectively to a plurality of colors are detachably fixed to the head unit 200. The carriage 202 onto which this head unit 200 is mounted is provided to a carriage shaft 204 attached to an apparatus main body 203 in a way that the carriage 202 is capable of freely moving in its axial direction.

The carriage 202 onto which the head unit 200 is mounted is moved along the carriage shaft 204 by transmission of a drive power of a drive motor 205 to the carriage 202 through a plurality of gears, which are not illustrated, and a timing belt 206. On the other hand, the apparatus main body 203 is provided with a platen 207 along the carriage shaft 204. Recording sheets S which are recording media to be fed in by feeding rollers (not illustrated) and the like are designed to be transferred over the platen 207. The recording media includes sheets of paper.

The foregoing embodiment has been described, taking the inkjet recording heads each for ejecting an ink as an example of the liquid-jet head. However, the invention is intended to be widely applied to the entire range of liquid-jet heads and liquid-jet apparatuses. Examples of the liquid-jet heads include: color-material-jet heads used for manufacturing color filters of liquid crystal display devices and the like; electrode-material-jet heads used for forming electrodes of organic EL display devices, FED (Field Emission Display) devices and the like; and bio-organic-substance-jet heads used for manufacturing bio-chips.

What is claimed is:

1. A liquid-jet head comprising:

head main bodies each including at least a nozzle plate in which nozzle orifices are formed, each of the nozzle orifices being that from which liquid droplets are ejected; a passage-forming substrate, the nozzle plate being joined to one surface of the passage-forming substrate, and a plurality of pressure generating chambers which respectively communicate with the nozzle orifices being arranged side by side in the passage-forming substrate; and pressure generators, each of which applies pressure to a liquid in each of the corresponding pressure generating chambers; and a fixing plate including exposure ports through which to expose the nozzle orifices to the outside respectively in areas in the fixing plate, which correspond to the head main bodies, the plurality of head main bodies being aligned and fixed, at predetermined intervals, to the fixing plate, the liquid-jet head wherein the fixing plate includes a reservoir forming plate, a compliance plate and a sealing plate, the reservoir forming plate being provided with a reservoir communicating with the plurality of pressure generating chambers, the compliance plate being joined to one surface of the reservoir forming plate, the compliance plate including a flexible portion in an area in the compliance plate, which faces the reservoir, the flexible portion being capable of changing in shape depending on change of pressure in the reservoir, the sealing plate being joined to the other surface of the reservoir forming plate, and the sealing plate thus sealing the reservoir.

2. The liquid-jet head as recited in claim 1, wherein the pressure generating chambers and the reservoir communicate with each other through a penetrated hole provided in the compliance plate, and through a supply port including a plurality of fine holes provided in the nozzle plate.

3. The liquid-jet head as recited in claim 1, wherein the nozzle plate is formed of a single crystal silicon substrate.

4. The liquid-jet head as recited in claim 1, wherein the compliance plate includes an elastic sheet formed of an elastic material, and a reinforcement plate which is joined to the top of the elastic sheet, and which thus fixes the elastic sheet thereto, and the flexible portion is formed of the elastic sheet only.

5. The liquid-jet head as recited in claim 1, wherein a passage member is further joined to the top of the fixing plate, a communicating path being provided in an area in the passage member, the area corresponding to the reservoir, the communicating path constituting a part of a passage connecting the reservoir and a liquid holding mean in which a liquid to be supplied to the reservoir is held, and the passage member including head holding portions respectively in areas in the passage member, which correspond to the head main bodies.

6. The liquid-jet head as recited in claim 1, wherein the pressure generators are piezoelectric elements provided to the passage-forming substrate's surface which is opposite to its surface facing the nozzle plate with a vibration plate interposed between the passage-forming substrate and each of the piezoelectric elements.

7. A liquid-jet apparatus comprising the liquid-jet head as recited in claim 1.

* * * * *